United States Patent [19]

Powderley et al.

[11] 4,373,318

[45] Feb. 15, 1983

[54] STACKING DEVICE FOR HOLLOW RIVETS

[75] Inventors: John Powderley, Birmingham; David J. Brookes, Sutton Coldfield, both of England

[73] Assignee: USM Corporation, Farmington, Conn.

[21] Appl. No.: 163,216

[22] Filed: Jun. 26, 1980

[51] Int. Cl.[3] ..... B65B 35/50; B65B 27/06; B65B 13/08

[52] U.S. Cl. ..... 53/540; 53/581; 414/27

[58] Field of Search ..... 53/540, 204, 581; 414/69, 27; 29/241, 433

[56] References Cited

U.S. PATENT DOCUMENTS

| | | | |
|---|---|---|---|
| 2,295,469 | 9/1942 | Hall et al. | 53/581 X |
| 2,350,273 | 5/1944 | Decker | 414/27 |
| 2,861,407 | 11/1958 | Hamlin et al. | 53/581 X |
| 3,002,327 | 10/1961 | Kirby | 53/581 |
| 3,286,856 | 11/1966 | Greenlay et al. | 414/57 |
| 3,683,588 | 8/1972 | Ahlers | 53/308 X |

FOREIGN PATENT DOCUMENTS

| | | | |
|---|---|---|---|
| 2504748 | 7/1975 | Fed. Rep. of Germany | 53/204 |

*Primary Examiner*—Horace M. Culver
*Attorney, Agent, or Firm*—William F. White

[57] ABSTRACT

A stacking device for stacking headed tubular fasteners. The device comprises air blowing means which accelerates an end fastener in a guide relative to the remaining fasteners in the guide thereby ensuring that each fastener leaves the guide separately without jamming to fall into a stacking passage in which the fasteners form a column one-above-the-other. The stacking device is utilized for stacking rivets in a rivet packaging machine which assembles a column of rivets on a sleeve made of resilient plastics material for later transfer to the mandrel of a pull-through blind riveting tool.

11 Claims, 5 Drawing Figures

STACKING DEVICE FOR HOLLOW RIVETS

BACKGROUND OF THE INVENTION

This invention is concerned with a stacking device and packaging machine for headed tubular fasteners. In particular the invention concerns a stacking device suitable for use in stacking headed tubular fasteners, such as rivets, in a column one-above-the-other head to tail, such a stacking device forming part of a packaging machine for such fasteners.

DESCRIPTION OF THE PRIOR ART

In European Patent Specification No. 78300382.5 (Publication No. 1343), there is described an assemblage or packet of hollow rivets comprising a column of the rivets assembled head to tail on a sleeve. This assemblage is for use in loading hollow rivets on to a headed mandrel so that they can be set in a pull-through blind riveting operation. In such an operation, a column of, for example, 30 to 60 rivets is assembled on a mandrel, the mandrel is inserted in a blind riveting tool which has means for gipping and pulling the mandrel through a rivet to set it, and the rivets in the column are set by successive operations of the tool. There is a need for a machine which can make the above-mentioned assemblages or packets and such a machine requires a stacking device to stack the rivets.

OBJECTS OF THE INVENTION

It is an object of the present invention to provide a stacking device suitable to form part of a machine for making an assemblage or packet of hollow rivets.

SUMMARY OF THE INVENTION

There is hereinafter described in detail with reference to the accompanying drawings a machine for making an assemblage or packet of hollow rivets which is illustrative of the invention. The illustrative machine comprises a stacking device, also itself illustrative of the invention, which device stacks headed tubular fasteners (viz. hollow rivets) in a column one-above-the-other head to tail. The illustrative device comprises feeding means including a vibratory hopper, vibrating means operable to vibrate the hopper, a raceway arranged to collect and feed rivets emerging from the hopper, and a substantially horizontal guide to which the rivets are advanced from the raceway one after the other with their shanks substantially vertical by the operation of the feeding means. The illustrative device also comprises a collector which defines a substantially vertical passage which has its upper end adjacent an open exit end of the guide. The passage has transverse dimensions such that rivets falling into the passage are constrained to form a column one-above-the-other with their shanks substantially in alignment. Rivets leaving the guide through the exit end fall into the passage and form a column in the passage.

In order to ensure that rivets leaving the exit end of the guide do not form a jam in the end of the passage, the illustrative stacking device comprises air blowing means operable to cause the rivet nearest the exit end of the guide to accelerate relative to the other rivets in the guide and thereby separate that rivet from said other rivets to prevent jams. The air blowing means includes a nozzle positioned adjacent the guide and arranged to direct air blown through the nozzle towards the exit end of the guide. When air is blown through the nozzle, the rivet nearest the exit end of the guide is caused to accelerate relative to the other rivets in the guide and is thereby separated from said other fasteners thereby preventing jamming so that the fastener can fall into the guide.

The invention provides a stacking device suitable for use in stacking headed tubular fasteners in a column one-above-the-other head to tail, the device comprising feeding means including a substantially horizontal guide to which the fasteners are advanced one after the other with their shanks substantially vertical, a collector which defines a substantially vertical passage which has its upper end adjacent an open exit end of the guide so that fasteners leaving the guide through the exit end fall into the passage, the passage having transverse dimensions such that fasteners falling into the passage are constrained to form a column one-above-the-other with their shanks substantially in alignment, and air blowing means including a nozzle positioned adjacent the guide so that, when air is blown through the nozzle, the fastener nearest the exit end of the guide is caused to accelerate relative to the other fasteners in the guide and is thereby separated from said other fasteners to fall into the passage.

In order to insert the sleeve of a packet or assemblage of rivets through a column of rivets in the passage of the illustrative stacking device, the illustrative machine also comprises an elongated mandrel which is threaded through the column and then withdrawn pulling the sleeve therewith so that the sleeve is threaded through the column.

There now follows a detailed description, to be read with reference to the accompanying drawings, of the illustrative machine aforementioned. It is to be understood that the illustrative machine and the illustrative stacking device which forms part thereof have been selected for description by way of example and not of limitation of the invention.

DESCRIPTION OF THE PREFERRED EMBODIMENTS

Figure 1:
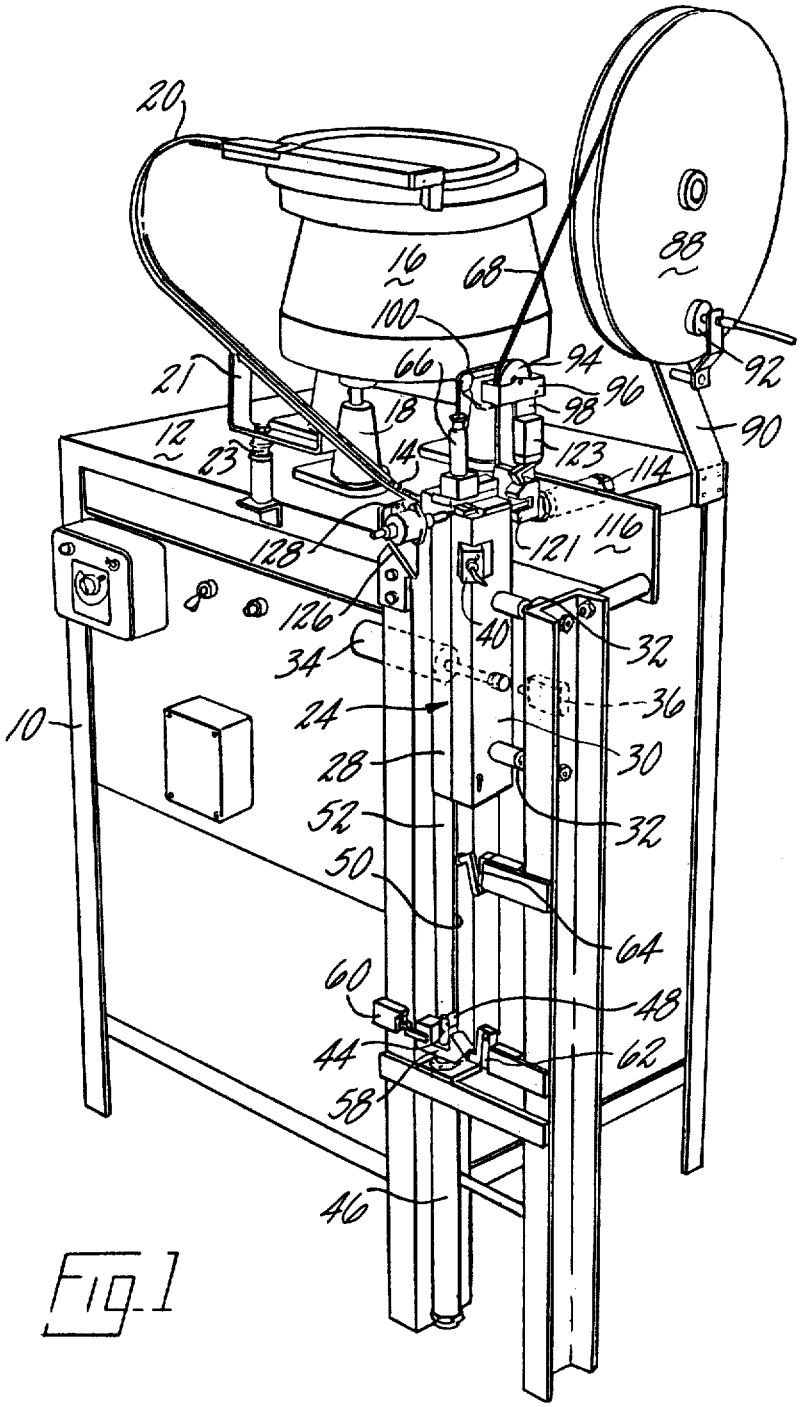
FIG. 1 is a perspective view of the illustrative machine.
Figure 3:
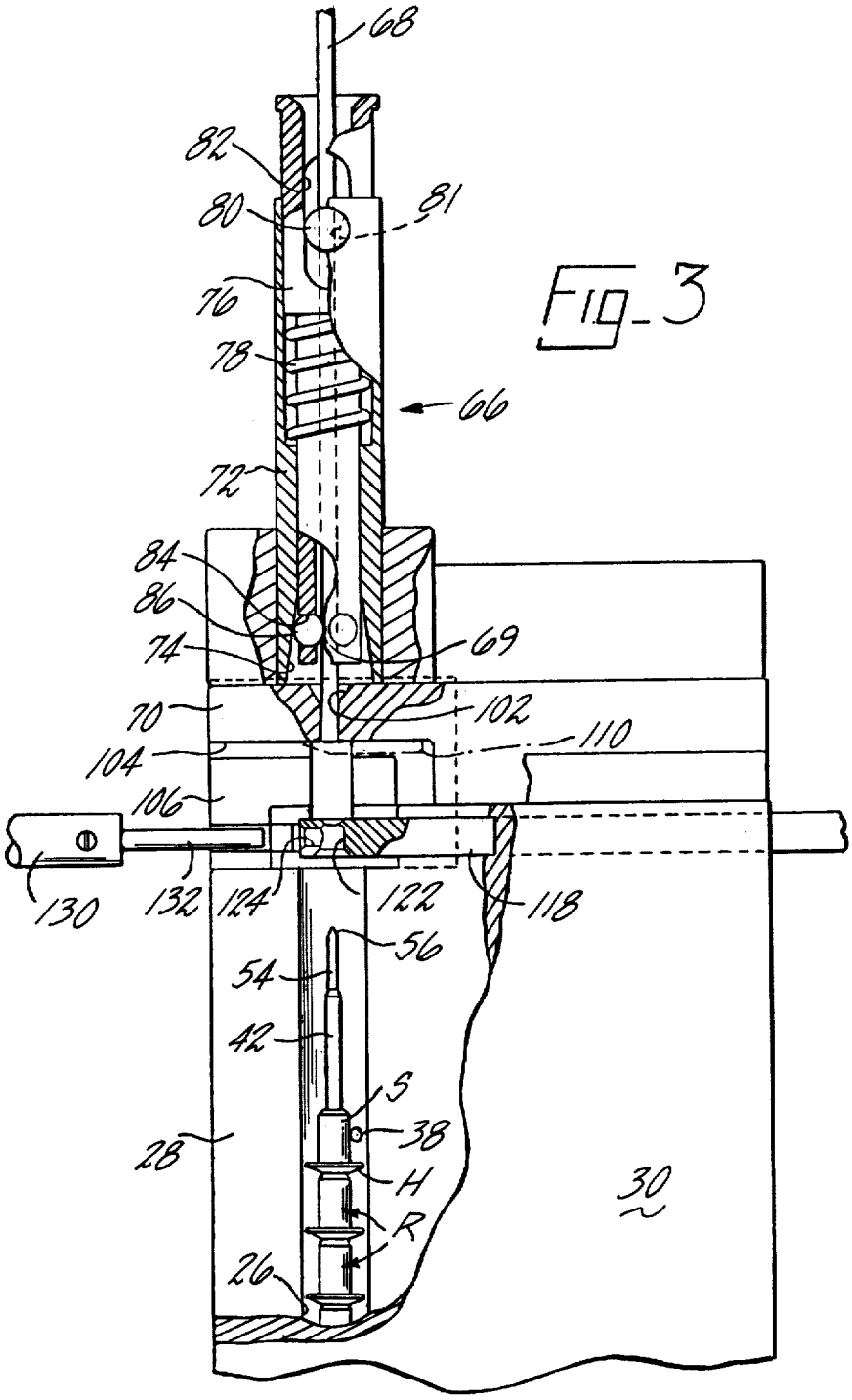
FIG. 3 is an elevational view, partly in section and on a larger scale than FIG. 2, taken in the direction of the arrow III in FIG. 2.

The illustrative machine (FIG. 1) is for making an assemblage or packet of hollow rivets R which have heads H and shanks S (FIG. 3). The machine comprises a framework 10 which supports a table 12 (FIG. 1). The machine also comprises the illustrative stacking device which is supported by the framework 10 and the table 12.

Figure 2:
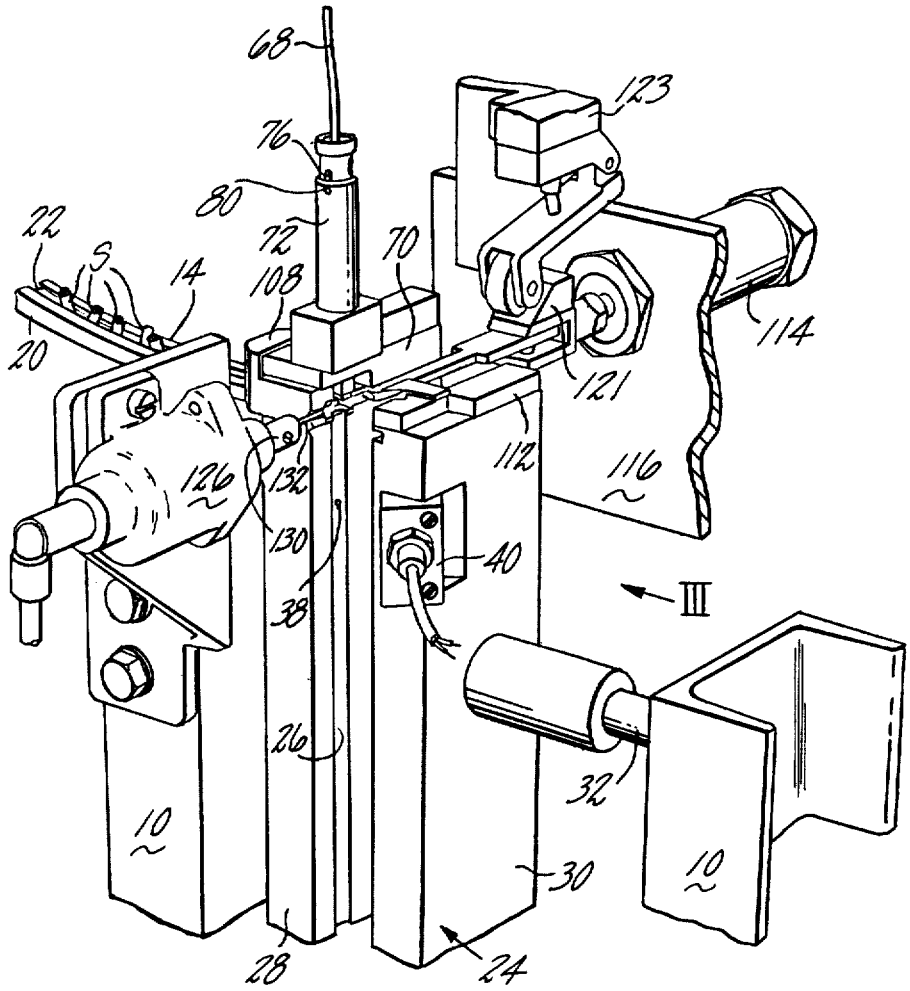
FIG. 2 is a perspective view, on a larger scale than FIG. 1, of a portion of the illustrative stacking device of the illustrative machine.

The illustrative stacking device is for use in stacking the rivets R in a column one-above-the-other head to tail. The device comprises feeding means including a raceway 20 arranged to guide rivets R with their heads H in a channel and their shanks S projecting through a guidance slot 22 of the raceway 20 (FIGS. 1 and 2). The rivets R are advanced one after the other along the raceway 20 to a guide 14 where their shanks S are substantially vertical. The feeding means also comprises a hopper 16 supported above the table 12 on flexible mountings 18 so that vibration means of the hopper 16 can cause the hopper 16 to vibrate. The hopper 16 is of conventional design and is arranged when vibrating to feed rivets R placed in the hopper 16 one at a time into the raceway 20 of the feeding means. The raceway 20 is supported by a bracket 21 mounted on a flexible rubber bearing 23 mounted on the framework 10. The rivets R leaving the hopper 18 have their shanks pointing downwards but the raceway 20 makes a 180 degree turn so that the rivets R are inverted and their shanks then point upwards. A lower end portion of raceway 20 forms the substantially horizontal guide 14 to which the rivets R are fed one after the other with their shanks pointing upwards. The guide 14 is thus arranged to hold the rivets with their heads H lowermost. Rivets R pass into the guide 14 from the raceway 20 when the hopper 16 and the raceway 20 are vibrated by the vibrating means 18. When vibration ceases, the rivets in the guide 14 come to rest because the guide 14 is substantially horizontal.

Figure 5:
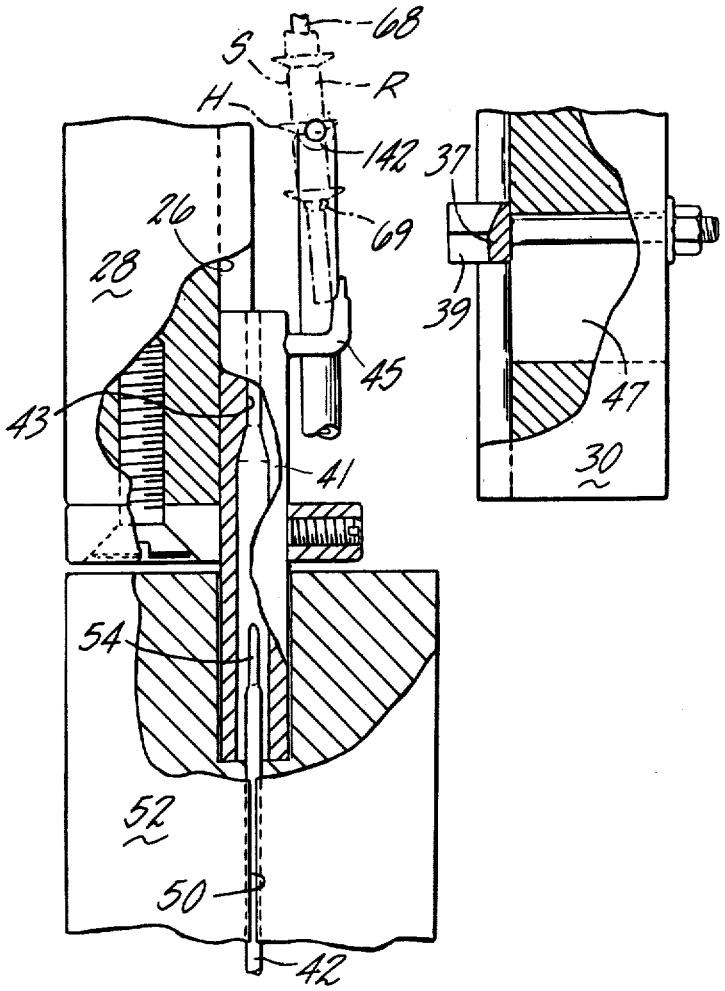
FIG. 5 is a side elevational view of a portion of the illustrative stacking device.

The illustrative stacking device also comprises a collector 24 which defines a substantially vertical cylindrical passage 26 which has its upper end adjacent an open exit end of the guide 14 so that rivets leaving the guide 14 through the exit end fall into the passage 26. Because the rivets are held in the guide 14 with their heads lowermost, when a rivet leaves the guide 14 through the exit end thereof, it falls head-first into the passage 26. The passage 26 has transverse dimensions such that rivets falling into the passage 26 are constrained to form a column one-above-the-other with their shanks S substantially in alignment (FIG. 3), i.e. the passage 26 is of slightly greater diameter than the heads H of the rivets R. The collector 24 comprises two passage-defining members 28 and 30 each having a semicircular groove therein which defines half of the passage 26. The member 28 is rigidly mounted on the framework 10 but the member 30 is slidable on two guide rods 32 (FIGS. 1 and 2) mounted on the framework 10 towards and away from the member 28 under the action of a pneumatic piston and cylinder assembly 34. The member 30 can be moved by operation of the assembly 34 between a closed condition of the collector 24 in which the two members 28 and 30 co-operate to define the passage 26 (FIG. 1) and an open condition in which a column of rivets stacked in the passage 26 can be removed therefrom (FIGS. 2 and 5). When the collector 24 is in the open condition, the member 30 operates a mechanically-operated pneumatic valve 36 (FIG. 1) mounted on the framework 10. The purpose of the valve 36 will appear from the description below of the operation of the illustrative machine.

The collector 24 also comprises detecting means operable to detect when a predetermined number of rivets has been stacked in the passage 26. The detecting means comprises a photo-electric cell 38 mounted at one side of the passage 26 on the member 28 and arranged to receive light from a light source provided by a lamp 40 mounted at the other side of the passage 26 on the other passage-defining member 30. The photo-electric cell 38 and the lamp 40 are arranged at an angle to the direction of movement of the member 30 so that the cell 38 and lamp 40 are only aligned in the closed condition of the members 28 and 30. Thus, light is received by the photo-electric cell 38 only when the collector 24 is in its closed condition and when the light from the lamp 40 is not intercepted by a rivet in the passage 26. The photo-electric cell 38 is arranged to signal that the predetermined number of rivets is in the passage. It is operative when the collector 24 is in the closed condition and when the light from the lamp 40 is interrupted for a predetermined time, which time is longer than the time which a rivet takes to fall past the photo-electric cell 38.

When a rivet R falls into the passage 26, it comes to rest, if it is the first rivet in a column, with its head resting on a catcher 37 (FIG. 5). The catcher 37 is mounted on a lower portion of the member 30 of the collector 24 and is horseshoe-shaped with an opening 39 therein facing the member 28. Subsequent rivets R come to rest on top of previous rivets. A guidance tube 41 is mounted on a lower portion of the member 28 of the collector 24 closing the passage 26 below the catcher 37 except for the bore 43 of the tube 41. The tube 41 carries a hook 45 which projects towards the member 30 when the collector 24 is in its closed condition. The hook 45 also projects upwardly to a point just below the level of the catcher 37.

The illustrative machine also comprises an elongated mandrel 42 (FIGS. 3 and 5) supported on the piston rod 44 (FIG. 1) of a pneumatic piston and cylinder assembly 46 mounted on the framework 10 beneath the collector 24. The mandrel 42 has transverse dimensions such that it can be threaded through a column of rivets formed in the passage 26. The assembly 46 provides moving means operable to move the mandrel 42 upwards longitudinally thereof so that the mandrel 42 is threaded through the column as aforesaid and to withdraw the mandrel 42 from the column again (FIG. 1). The mandrel 42 is mounted on a bracket 48 which projects sideways from the piston rod 44 into a groove 50 in a block 52 mounted on the framework 10. The groove 50 acts as a guide for the mandrel 42 and connects with the lower end of the tube 41 (FIG. 5) so that the mandrel 42 can enter the passage 26 by passing through the bore 43 in the tube 41.

The mandrel 42 has an upper free end portion 54 of reduced diameter (FIG. 3) which terminates in a pointed end 56. The operation of the assembly 46 is arranged to move the mandrel 42 upwards through a column of rivets in the passage 26. In order to minimize the risk that the mandrel 42 will jam against a rivet during its passage through a column, the assembly 46 is so arranged that, upon the pressure rising in the cylinder of the assembly 46 which occurs when the mandrel 42 meets resistance, the air supply to the assembly is cut off so that the piston and mandrel 42 fall under their own weight until the pressure falls again whereupon the air supply is restored. This arrangement assists the mandrel 42 in passing through the rivets R in the column since it allows time for the rivets to re-align themselves slightly as the mandrel 42 passes through them. The fact that the mandrel 42 enters the column from below assists in its passing through the column since the rivets R can be lifted relative to one another during re-alignment of the rivets R as the mandrel 42 passes therethrough.

The piston rod 44 of the assembly 46 carries a crosshead 58 which is arranged to operate three mechanically-operated pneumatic valves 60, 62 and 64 mounted on the framework 10. The valves 60 and 62 are arranged to be operated when the mandrel 42 is completely out of the column of rivets and the valve 64 is arranged to be operated when the mandrel 42 is fully in the column with the reduced end portion 54 thereof projecting beyond the top of the column. The purpose of each of the valves 60, 62 and 64 will appear from the description below of the operation of the illustrative machine.

The illustrative stacking device also comprises holding means 66 (FIGS. 1 and 5) arranged to hold a sleeve 68 made of resilient plastics material with an open end of the sleeve adjacent to the upper end of the passage 26 and to resist movement of the sleeve 68 away from the passage 26. The reduced end portion 54 of the mandrel 42 has transverse dimensions such that it can enter the sleeve 68 causing the sleeve 68 to expand and grip the portion 54. Thus, after passing through the column of rivets in the passage 26, the portion 54 can enter the sleeve 68 held by the holding means 66 so that the sleeve 68 expands and grips the portion 54, and, upon operation of the assembly 46 to withdraw the mandrel 42 from the column of rivets, the sleeve 68 is pulled through the column so that the rivets become threaded on the sleeve 68.

The details of the holding means 66 appear from FIG. 3. The holding means 66 mounted on a block 70 supported by the member 28 of the collector 24. The holding means comprises a vertical tube 72 having a bore 74 therethrough a bottom end portion of which tapers outwardly. An inner tube 76 is vertically slidable in the bore 74 being urged upwardly by a spring 78 which acts between a shoulder in the bore 74 and a shoulder on the inner tube 76. The movement of the inner tube 76 is restrained by a transverse pin 80 mounted on an upper portion of the tube 72 and extending through an elongated slot 82 in the inner tube 76; the pin 80 has a vertical bore 81 therethrough for the passage of the sleeve 68. A lower end portion of the inner tube 76 has three equally-spaced radial bores 84 extending through the wall thereof at the same distance from the bottom of the tube and a ball 86 is contained in each of the bores 84, each ball 86 engaging the outwardly tapering portion of the bore 74 and extending into the bore through the inner tube 76.

The sleeve 68 is supplied to the illustrative stacking device from a reel 88 mounted for rotation about a horizontal axis on a bracket 90 mounted on the framework 10. The reel 88 is provided with a pneumatically-operated friction brake 92 which prevents free rotation of the reel 88 but allows the sleeve 68 to be drawn from the reel 88 by pulling on the sleeve 68 thereby rotating the reel 88. From the reel 88, the sleeve 68 passes to a pulley 94 which is rotatable about a horizontal axis with its lower portion immersed in lubrication oil contained in an oil tank 96 mounted on a bracket 98 on the table 12. The sleeve 68 makes a complete turn around the pulley 94 so that it receives a thin coating of oil from the tank 98. The lubrication oil is transferred to the rivets R from the sleeve 68 and will assist the setting of the rivets. From the pulley 94, The sleeve 68 passes to a guide pulley 100 and then descends vertically through the inner tube 76, the bore 81 in the pin 80, between the balls 86 and into a vertical bore 102 in the block 70 (FIG. 3).

The operation of the holding means 66 will now be described. The spring 78 urges the inner tube 76 upwardly pulling the balls 86 towards the narrow upper end of the outwardly tapering portion of the bore 74. The balls 86 are thus urged together and grip the sleeve 68 preventing upward movement thereof. However, if the sleeve 68 is pulled downwardly, the balls 86 are drawn towards the wide lower end of the tapering portion, against the action of the spring 78, releasing their grip and allowing movement of the sleeve 68 downwardly. The region 69 (FIGS. 3 and 5) of the sleeve 68 which the balls 86 grip becomes deformed by the balls 86 in such a manner that, although it does not prevent the sleeve 68 passing through rivets R, it acts to prevent rivets R accidently falling off the sleeve 68.

Figure 4:
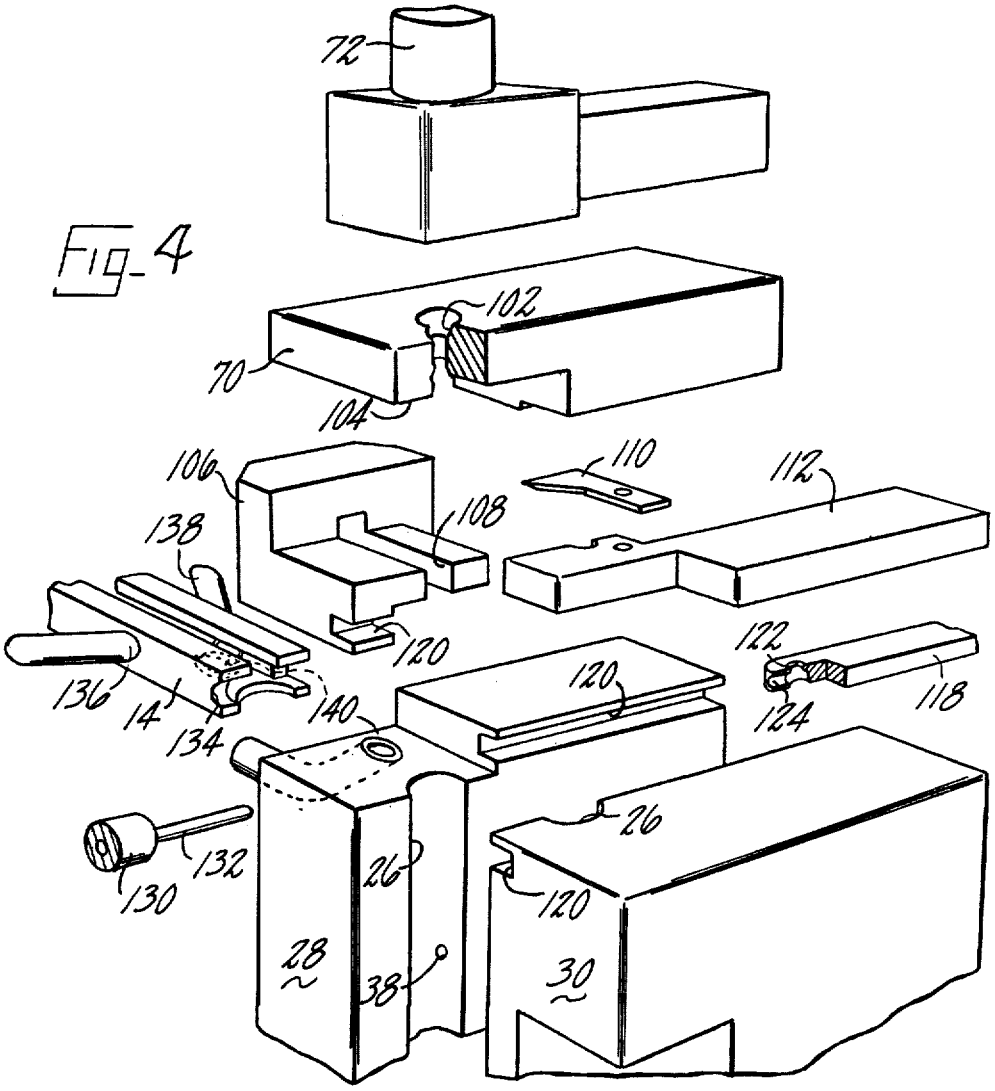
FIG. 4 is an exploded perspective view of a portion of the illustrative stacking device.

The lower end of the bore 102 in the block 70 communicates with a slot 104 (FIGS. 3 and 4) formed between the block 70 and a block 106 mounted on the member 28. The block 106 also has a vertical slot 108 therein which receives the shanks S of rivets R as they leave the guide 14. A knife 110 mounted on a block 112 carried by the member 30 moves in the slot 104 so that it cuts through the sleeve 68 immediately below the block 70 as the member 30 moves away from the member 28.

A pneumatic piston and cylinder assembly 114 is mounted on a support plate 116 mounted on the framework 10 (FIG. 1). The piston rod of the assembly 114 carries a closure member 118 (FIG. 4) which is slidable in a slot 120 formed in upper portions of the members 28 and 30 and partially in the block 70. The closure member 118 is movable by the action of the assembly 114 to a forward position in which it closes the upper end of the passage 26 preventing further rivets from falling into the passage 26. The closure member 118 has a vertical bore 122 therethrough in which the sleeve 68 is received and a horizontal bore 124 therein connecting with the bore 122. The piston rod of the assembly 114 also carries a crosshead 121 arranged to operate a pneumatic valve 123 for a purpose to be described.

A pneumatic piston and cylinder assembly 126 (FIG. 1) is mounted on a bracket 128 which extends forwardly from the framework 10. The piston rod 130 (FIGS. 3 and 4) of the assembly 126 carries a plunger 132 arranged, under the action of the assembly 126, to pass through a groove 134 in the end of the guide 14 and enter the bore 124 in the closure member 118 engaging the sleeve 68 in the bore 122 and flattening the sleeve 68 against the wall of the bore 122 to deform the sleeve 68. The assembly 126 forms deforming means operable to deform an end portion of the sleeve 68 after the sleeve 68 has been threaded through the column of rivets in order to minimize the risk of the rivets falling off the sleeve 68.

The illustrative stacking device also comprises air blowing means including three nozzles 136, 138 and 140 (FIG. 4) positioned adjacent the guide 14. The nozzles 136 and 138 enter opposite sides of the guide 14 and the nozzle 140 enters the guide 14 from below. The nozzles 136, 138 and 140 are so positioned that, when air is blown through the nozzles, the rivet R nearest the exit end of the guide 14 is caused to accelerate relative to the other rivets in the guide 14 and is thereby separated from said other fasteners to fall into the passage 26. The air blowing means ensures that rivets R entering the passage 26 do not interfere with one another causing a jam.

The illustrative machine also comprises ejecting means comprising a nozzle 142 (FIG. 5) positioned to one side of the collector 24 and arranged to direct air on to a packet of rivets R in the collector 24, when the collector is in its open condition, to eject the packet from the collector 24.

A cycle of operation of the illustrative machine will now be described starting from the condition shown in FIG. 1. In this condition, the guide 14 and the raceway 20 contain rivets R which have previously been fed from the hopper 16 by operation of the vibrating means. The collector 24 is in its closed condition and the holding means 66 is holding the open end of the sleeve 68 above the passage 26. The piston and cylinder assemblies 46 and 114 are respectively holding the mandrel 42 and the closure member 118 clear of the passage 26.

In the operation of the illustrative machine, the air blowing means is operated blowing air through the nozzles 136, 138 and 140 thereby causing rivets to fall one at a time into the passage 26 and, at the same time, the vibrating means of the hopper 16 is operated to ensure a continuous supply of rivets to the guide 14. The first rivet which falls into the passage 26 comes to rest with its head on the catcher 37 and subsequent rivets pile up on the first rivet to form a column one-above-the-other with their shanks substantially in alignment.

When the column of rivets in the passage 26 reaches the photoelectric cell 38, the cell 38 creates a signal which causes the vibrating means and the air blowing means to be turned off thereby cutting off the feed of rivets to the passage 26. The signal also causes the assembly 114 to move the closure member 118 forwardly into a position in which it ensures that no further rivets fall into the passage 26. Operation of the assembly 114 causes the valve 123 to be operated and this causes the assembly 46 to move the mandrel 42 upwardly, so that the mandrel 42 passes upwardly through the column of rivets and its reduced end portion 54 enters the sleeve 68 held by the holding means 66 so that the sleeve 68 grips the portion 54. As the portion 54 is gripped by the sleeve 68, the crosshead 58 operates the valve 64 which causes the assembly 46 to reverse its direction of movement.

The assembly 46 now withdraws the mandrel 42 from the column of rivets thereby drawing the sleeve 68 through the column. When the sleeve 68 reaches the tube 41 at the lower end of the passage 26, the sleeve 68 is stripped off the mandrel 42 by the upper end of the tube 41 as the reduced end portion 54 withdraws into the bore 43 in the tube 41. The crosshead 58 now operates the valves 60 and 62 with the valve 60 being operated before the valve 62.

Operation of the valve 60 causes the assembly 126 to operate sending the plunger 132 through the bore 124 into contact with the sleeve 68 in the bore 122. The plunger 132 deforms the sleeve 68 leaving it with a flattened region (not shown) which acts to prevent the rivets R from accidently falling off the sleeve 68. The plunger 132 is returned when the crosshead 58 releases the valve 60 which it does immediately before operating the valve 62.

Operation of the valve 62, causes operation of the assembly 34 to move the collector 24 to its open condition. As the member 30 moves, the knife 110 cuts off the sleeve 68 and the hook 45 draws the lower end of the sleeve 68 out of the opening 39 in the catcher 37. The movement of the member 30 continues until the valve 38 is operated thereby whereupon a blast of air from the nozzle 142 ejects the rivet packet from the passage 26. The operation of the valve 36 also causes the assembly 34 to reverse its movement so that the collector 24 is returned to its closed condition ready for a further cycle of operation of the machine. When the collector 24 again reaches its closed condition, the photo-electric cell 38 again receives light from the lamp 40 and produces a signal which causes operation of the assembly 114 to withdraw the closure member 118 from the passage 26, the vibrating means to re-start, and also air to be supplied to the air blowing means so that air is blown through the nozzles 136, 138 and 140. The illustrative machine can now repeat its cycle of operation to make another rivet packet.

If desired the illustrative stacking device may be modified so that, instead of the holding means 66, the device may comprise sleeve feeding means operable to feed the sleeve 68 around the mandrel 42 while the mandrel 42 is threaded through the column of rivets so that the sleeve 68 becomes threaded through the column over the mandrel 42. The mandrel 42 could then be withdrawn leaving the sleeve 68 threaded through the column.

Having thus described our invention, what we claim as new and desire to secure by Letters Patent of the United States is:

1. A stacking device suitable for use in stacking headed tubular fasteners in a column one-above-the-other head to tail, the device comprising feeding means including a substantially horizontal guide to which the fasteners are advanced one after the other with their shanks substantially vertical, a collector which defines a substantially vertical passage which has its upper end adjacent an open exit end of the guide so that fasteners leaving the guide through the exit end fall into the passage, the passage having transverse dimensions such that fasteners falling into the passage are constrained to form a column one-above-the-other with their shanks substantially in alignment, and air blowing means including a nozzle positioned adjacent the guide so that, when air is blown through the nozzle, the fastener nearest the exit end of the guide is caused to accelerate relative to the other fasteners in the guide and is thereby separated from said other fasteners to fall into the passage, means associated with the vertical passage of said collector, for packaging a column of stacked fasteners, said packaging means comprising means for moving a mandrel upwardly, longitudinally through a column of fasteners formed in the passage.

2. A stacking device according to claim 1 wherein the guide is arranged to hold the fasteners with their heads lowermost so that, when a fastener leaves the guide through the exit end thereof, the fastener falls head-first into the passage.

3. A stacking device according to either one of claims 1 and 2 wherein the collector comprises two passage-defining members mounted for relative movement between a closed condition in which the two members co-operate to define the passage and an open condition in which a column of fasteners stacked in the passage can be removed therefrom.

4. A stacking device according to claim 3 wherein the collector comprises detecting means operable to detect when a predetermined number of fasteners have been stacked in the passage and thereupon to render the air blowing means inoperative.

5. A stacking device according to claim 4 wherein the detecting means comprises a photo-electric cell mounted at one side of the passage on one of the passage-defining members and arranged to receive light from a light source mounted at the other side of the passage on the other of the passage-defining members when the members are in their closed condition and when the light is not intercepted by a fastener in the passage.

6. The stacking device of claim 1 wherein said packaging means further comprises:

means for feeding a sleeve made of resilient plastics material around the upwardly moved mandrel.

7. The stacking device of claim 6 wherein the mandrel has a free end portion which has transverse dimensions such that it can enter the sleeve made of resilient plastic material and cause the sleeve to expand and grip the free end portion of the mandrel so that, upon operation of the moving means to withdraw the mandrel from the column, the sleeve is pulled through the column.

8. The stacking device of claim 7 wherein said packaging means further comprises:

means for deforming an end portion of the sleeve after the sleeve has been pulled through the column.

9. The stacking device of claim 6 wherein said sleeve feeding means further comprises:

means for holding the sleeve so that an open end of the sleeve is adjacent the upper end of the passage, the open end of the sleeve thereby being positioned to receive the free end portion of the mandrel when said mandrel is moved upwardly through the column of fasteners.

10. The stacking device of claim 9 wherein the mandrel has a free end portion which has transverse dimensions such that entry of the mandrel into the open end of the sleeve causes the sleeve to expand and grip the free end portion so that, upon operation of the moving means to withdraw the mandrel from the column, the sleeve is pulled through the column.

11. The stacking device of claim 10 wherein said packaging means further comprises:

means for deforming an end portion of the sleeve after the sleeve has been pulled through the column.

* * * * *